US007874810B2

(12) United States Patent
Huang

(10) Patent No.: US 7,874,810 B2
(45) Date of Patent: Jan. 25, 2011

(54) CONSTANT PRESSURE PRESSURIZING WATER PUMP

(76) Inventor: Shun-Zhi Huang, No. 313, Ren Sin Road, Wu Lin Village, Ren Wu Township, Kaohsiung County (TW)

( * ) Notice: Subject to any disclaimer, the term of this patent is extended or adjusted under 35 U.S.C. 154(b) by 817 days.

(21) Appl. No.: 11/848,160

(22) Filed: Aug. 30, 2007

(65) Prior Publication Data

US 2009/0060752 A1 Mar. 5, 2009

(51) Int. Cl.
*F04B 49/00* (2006.01)
*F04B 49/06* (2006.01)

(52) U.S. Cl. ..... 417/38; 417/44.2

(58) Field of Classification Search ..... 417/38, 417/44.2, 423.1
See application file for complete search history.

(56) References Cited

U.S. PATENT DOCUMENTS 3,922,111 A * 11/1975 Deters ..... 417/26
4,247,260 A * 1/1981 Schonwald et al. ..... 417/38
4,659,291 A * 4/1987 Valdes ..... 417/38
5,190,443 A * 3/1993 Valdes ..... 417/38
5,771,921 A * 6/1998 Johnson ..... 137/505
5,947,690 A * 9/1999 Snel et al. ..... 417/38
6,227,241 B1 * 5/2001 Snel et al. ..... 137/560
6,305,416 B1 * 10/2001 Snel et al. ..... 137/560

* cited by examiner

*Primary Examiner*—Devon C Kramer
*Assistant Examiner*—Peter J Bertheaud
(74) *Attorney, Agent, or Firm*—Wang Law Firm, Inc.; Li K. Wang

(57) ABSTRACT

A water pressurizing pump includes a pump mounted in a compartment of a water tank for pressurizing and outputting water. The compartment is sealed by a cover having a first channel in communication between the compartment and a water supply coupler and a second channel having an end in communication with the first channel. A pressure tank is mounted to the other end of the second channel of the cover. A differential pressure valve unit is slideably mounted in the pressure tank adjacent to the second channel. The differential pressure valve unit is movable by the high water pressure in the second channel to allow water from the second channel to enter the pressure tank.

6 Claims, 9 Drawing Sheets

CONSTANT PRESSURE PRESSURIZING WATER PUMP

BACKGROUND OF THE INVENTION

1. Field of the Invention

The present invention relates to a constant pressure pressurizing water pump. More particularly, the present invention relates to a water pump for providing users with a stable pressure water source after pressurizing tap water. More specifically, the present invention relates to a water pump that can be used indoors for water supply.

2. Description of the Related Art

It is well known to use a first pressurizing water pump for pumping tap water into a storage tank on top of a building for the purposes of compensating insufficient pressure of tap water and to use a second pressurizing water pump for pumping water in the storage tank to the users in the building. The second pressurizing water pump is mounted between the storage tank and the piping at the users end. Tap water in the storage tank is pressurized before fed to the users. When a faucet is opened by a user, the pump is activated if a pressure detection switch detects that the water pressure in the piping drops below a predetermined value. When the faucet is closed, the pump keeps on running until the water pressure in the piping reaches a predetermined higher pressure, and the pressure detection switch sends a signal to turn off the pump.

Such a pressurizing water pump is used indoors, and the pump is repeatedly turned on and off due to various amounts of water output via the faucet, resulting in unstable output of water, which causes problems to a user taking a hot water bath. The temperature and pressure of the output water are unstable. Ignition of the water heater is also unstable.

Taiwan Patent Publication No. 500187 to Applicant discloses a pressurizing water pump including a pump and a pressure tank for providing a stable pressure water source. The pressure tank includes a flexible membrane in a housing to separate an interior of the pressure tank into two independent chambers one of which is filled with air. A check valve is mounted between the pressure tank and the pump. When the pressure in the pressure tank reaches a predetermined higher value, the pump is turned off. When the pressure in the pressure tank drops to a predetermined value, the pump is activated. When a faucet at a user end is opened, the pressure in the pressure tank is kept at a low value such that the pressurizing water pump can supply stable pressure tap water to the user to provide stable water output and to allow smooth ignition of the water heater.

The check valve is mounted in a chamber in the pressure tank and coupled with an upper cover of the pump, and the pressure tank is mounted on a flange of the storage tank and has an upper cover fixed to the flange. Furthermore, additional couplers are required for mounting the pressurizing water pump to the piping. All of these render a bulky structure and requires troublesome, inconvenient assembly and maintenance. Specifically, the whole pressurizing water pump must be detached if maintenance of the pressure tank is required.

It is therefore a need in a pressurizing water pump that allows easy assembly and maintenance while supplying constant pressure tap water to users.

SUMMARY OF THE INVENTION

A water pressurizing pump according to the preferred teachings of the present invention includes a water tank having a compartment for receiving water. A pump is mounted in the compartment for pressurizing and outputting water in the compartment of the water tank. A cover is mounted on top of the water tank to seal the compartment of the water tank. The cover includes a space in communication with the compartment of the water tank. The cover further includes a first channel having a first end in communication with the space of the cover and a second end adapted to be coupled with a water supply coupler. The cover further includes a second channel having a first end in communication with the first channel and a second end. Pressurized water is outputable through the first channel to the water supply coupler. A pressure tank is mounted to and in communication with the second end of the second channel of the cover. A differential pressure valve unit is slideably mounted in the pressure tank adjacent to the second channel. The differential pressure valve unit is movable by a pressure of pressurized water in the second channel higher than a first pressure value to allow water from the second channel to enter the pressure tank. A pressure switch is mounted on and in communication with the pressure tank for detecting water pressure in the pressure tank. The pump is turned off when the water pressure in the pressure tank is higher than a second pressure value that is lower than the first pressure value. The pump is activated when the water pressure in the pressure tank is lower than a third pressure value that is lower than the second pressure value.

The present invention will become clearer in light of the following detailed description of an illustrative embodiment of this invention described in connection with the drawings.

BRIEF DESCRIPTION OF THE DRAWINGS

The illustrative embodiment may best be described by reference to the accompanying drawings where.

Figure 1:
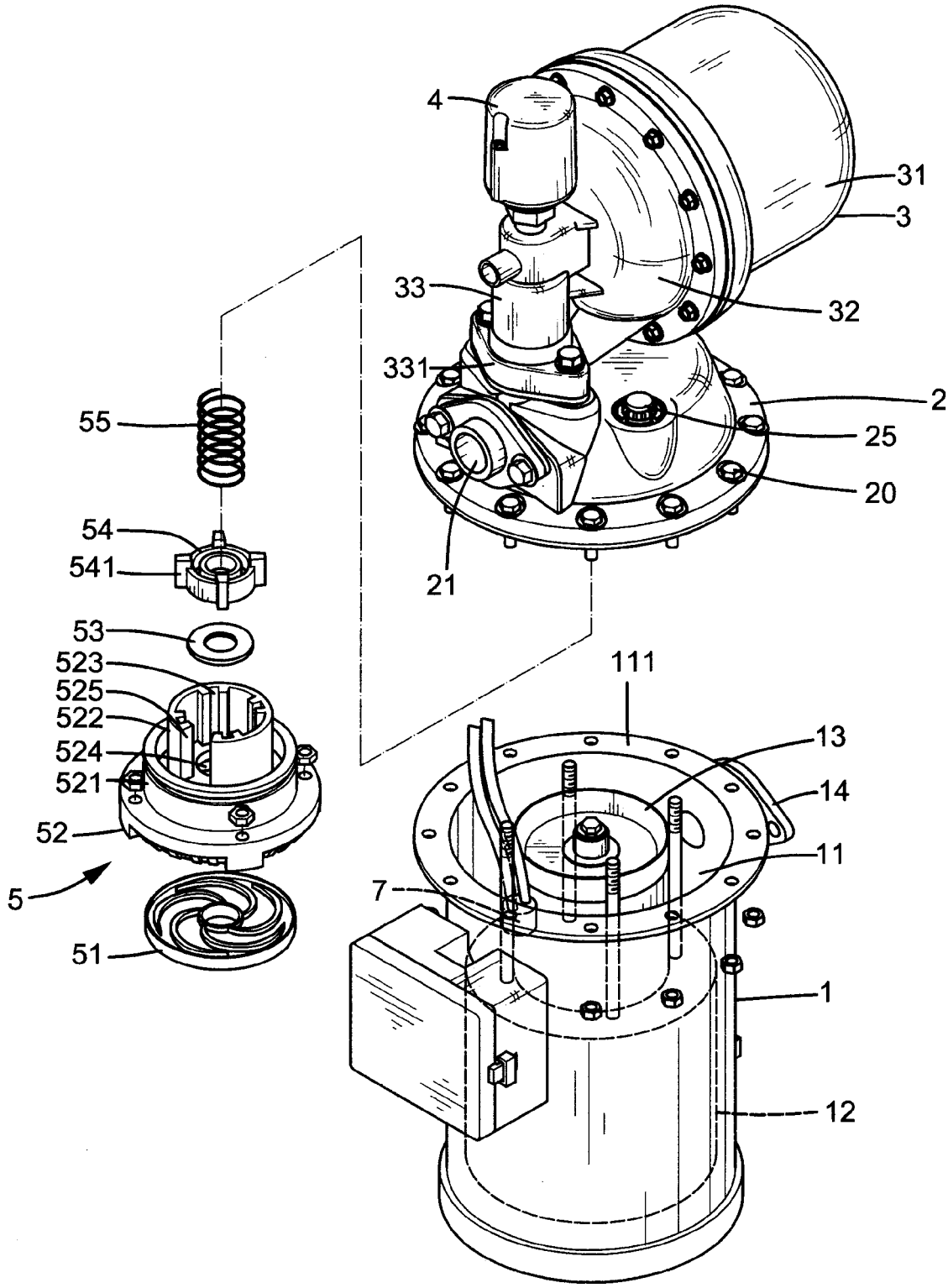
FIG. 1 shows an exploded perspective view of a constant pressure pressurizing water pump according to the preferred teachings of the present invention.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms 'first', 'second', 'inner', 'outer', 'lower', 'upper', 'front', 'rear', 'end', 'portion', 'section', 'longitudinal', 'annular', 'outward', 'length', and similar terms are used herein, it should be understood that these terms have reference only to the structure shown in the drawings as it would appear to a person viewing the drawings and are utilized only to facilitate describing the invention.

DETAILED DESCRIPTION OF THE PREFERRED EMBODIMENT

A constant pressure pressurizing water pump according to the preferred teachings of the present invention is shown in the drawings and includes a water tank 1 in which a pump 12 is mounted. A cover 2 is sealingly mounted on top of the water tank 1. A pressure tank 3 and a pressure switch 4 are mounted on the cover 2. The pump 12 pressurizes tap water in the water tank 1 and then outputs the pressurized tap water. The pressure tank 3 maintains the water pressure of the pressurizing water pump stable under cooperation with the power switch 4. An overheat switch 7 is mounted to the pump 12 for detecting the temperature of the pump 12. In a case that the pump 12 operates while no water in the water tank 1, the pump 12 is deactivated when the temperature of the pump 12 detected by the overheat switch 7 is higher than a predetermined value.

The water tank 1 includes a compartment 11 in which the pump 12 is received. A flange 111 is provided at an outlet of the compartment 11. A sleeve 13 is mounted on an upper end of the pump 12. A water inlet coupler 14 is mounted to a periphery of the water tank 1 and in communication with the compartment 11. The water inlet coupler 14 can be coupled with a tap water supply piping (or simply 'supply piping') for guiding tap water into the compartment 11 of the water tank 1. The pump 12 pressurizes the tap water in the compartment 11 and then outputs the pressurized tap water to the users. By such an arrangement, negative pressure will not be created in the supply piping. Thus, the constant pressure pressurizing water pump can be directly mounted on the supply piping.

Figure 3:
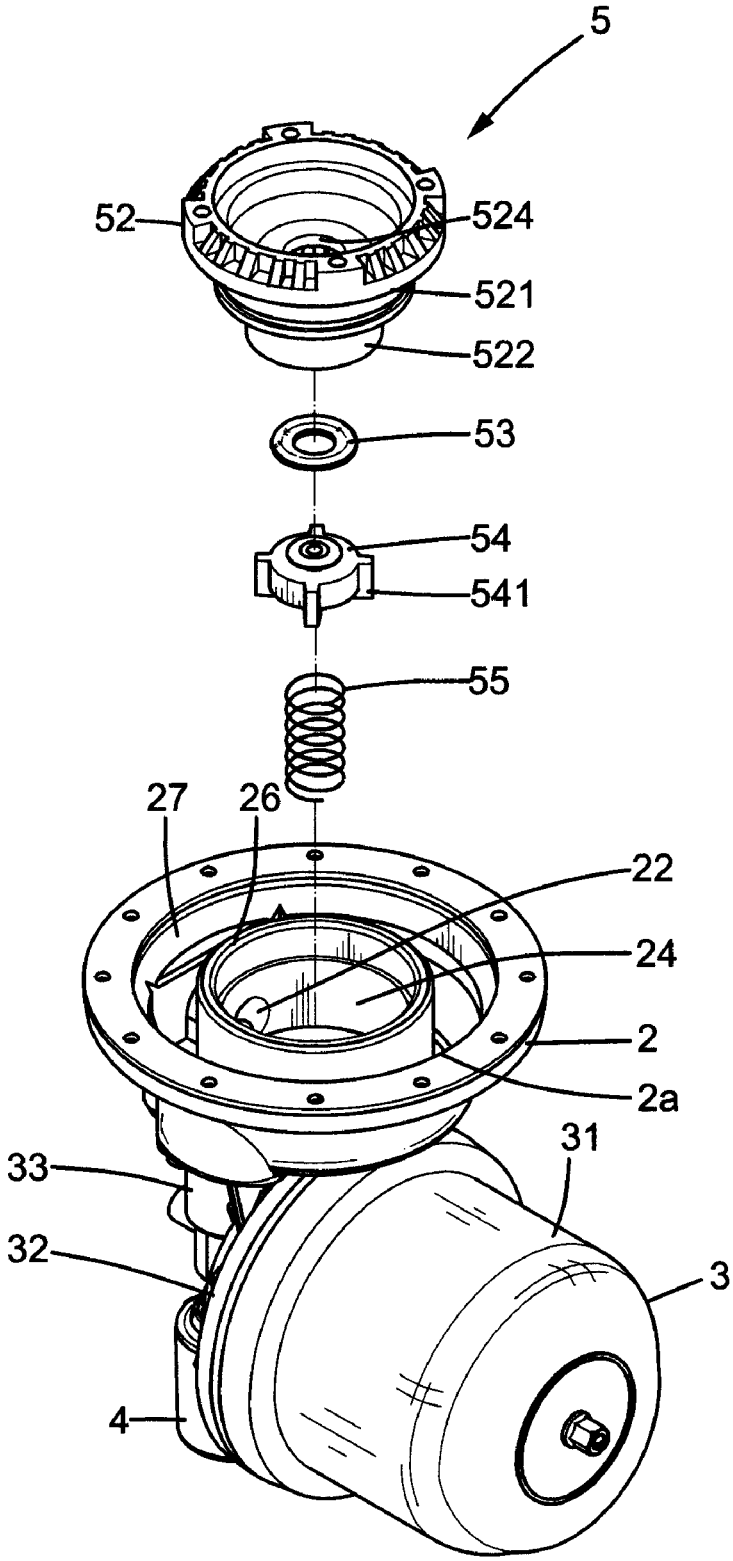
FIG. 3 shows a partially exploded perspective view of a check valve and a pressure tank of the constant pressure pressurizing water pump of FIG. 1.
Figure 4:
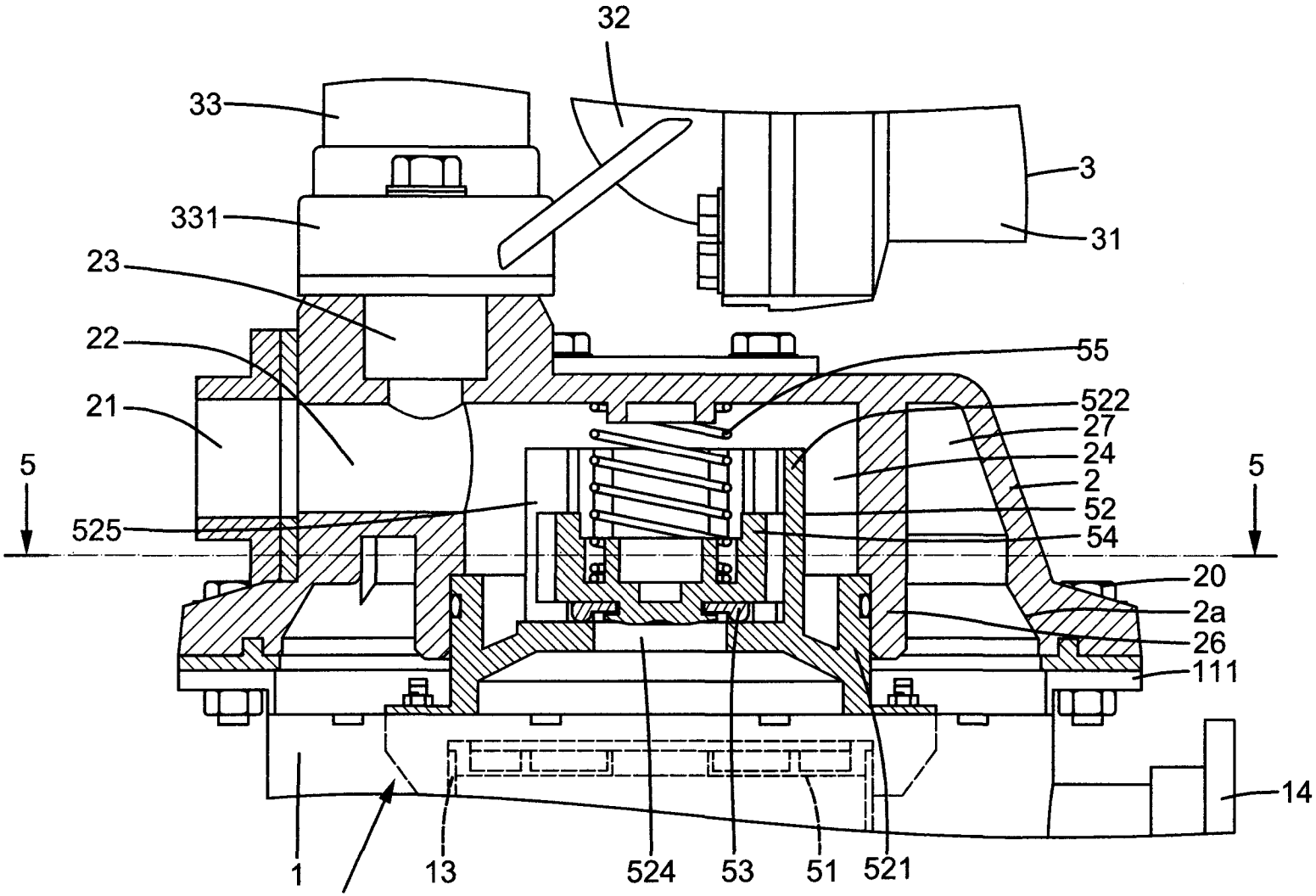
FIG. 4 shows a partial, enlarged cross sectional view of the constant pressure pressurizing water pump of FIG. 1.
Figure 5:
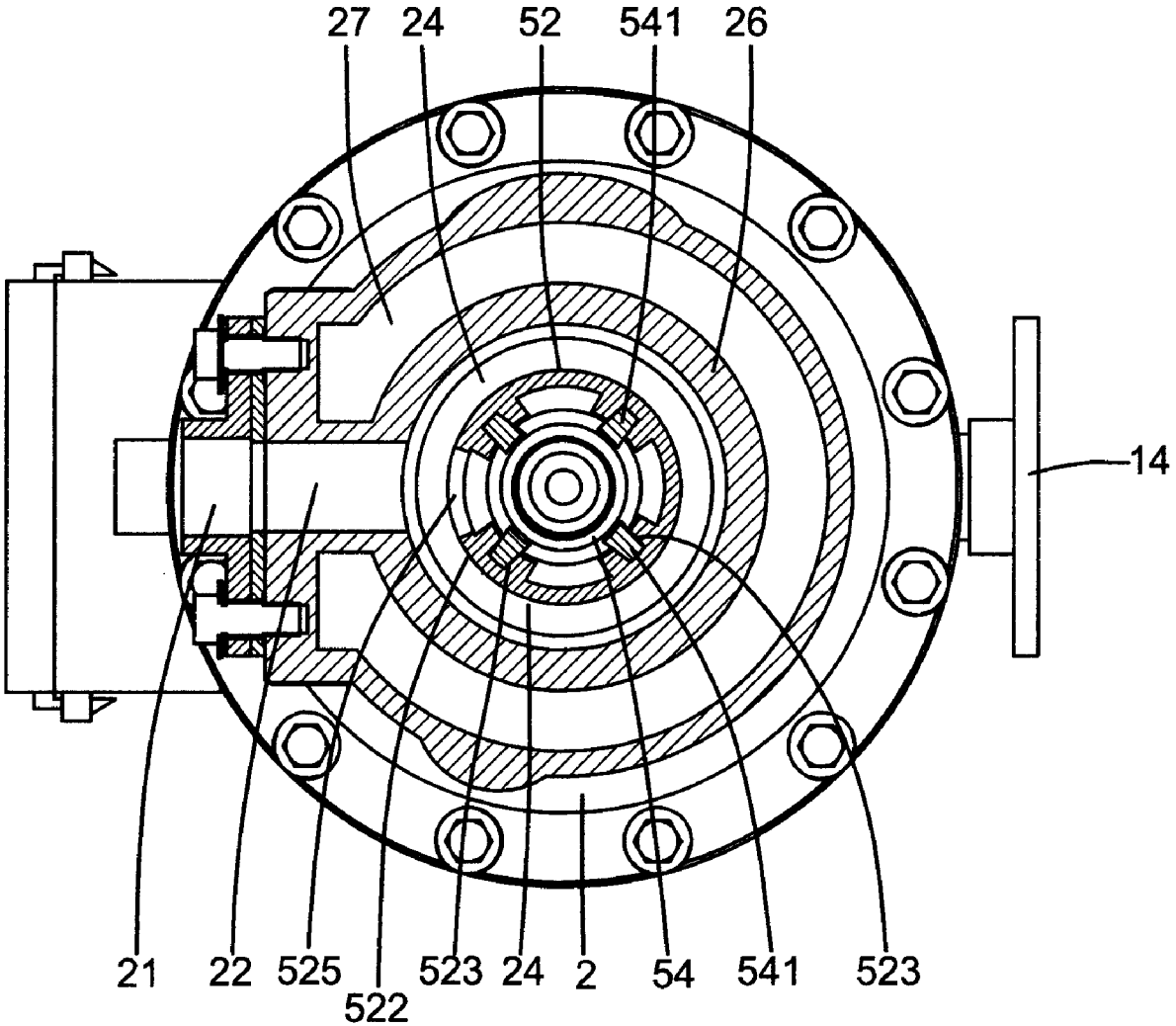
FIG. 5 shows a cross sectional view of the constant pressure pressurizing water pump of FIG. 1 according to section line 5-5 of FIG. 2.

With reference to FIGS. 3-5, the cover 2 has an outline conforming to that of the flange 111 of the water tank 1. The cover 2 is fixed by fasteners 20 to the flange 111 and seals the compartment 11. The cover 2 includes a substantially conic housing defining a space 2*a* in communication with the compartment 11. An air discharge valve 25 is mounted on the cover 2 and in communication with the space 2*a* for discharging air in the compartment 11. A first channel 22 is defined in the cover 2 and in communication with the space 2*a* and has an outer end extending through the cover 2. A water supply coupler 21 is mounted to the outer end of the first channel 22 and connected to a piping at the user end. Thus, pressurized tap water is output by the pump 12 to the user end via the first channel 22. In the most preferred form, the water supply coupler 21 is in the form of a flange having inner threading for direct threadedly coupling with the piping at the user end. A second channel 23 is defined in the cover 2 and has an end in communication with the first channel 22. The other end of the second channel 23 extends upward through the cover 2 and is connected to the pressure tank 3. Thus, pressurized tap water can be guided into the pressure tank 3 through the second channel 23.

In the preferred form shown, a partitioning wall 26 extends downward from an inner side of the cover 2 and separates the space 2*a* into a first chamber 24 and a second chamber 27. The second chamber 27 is in communication with the compartment 11 of the water tank 1. The air discharge valve 25 is mounted in the second chamber 27. Air in the compartment 11 of the water tank 1 is discharged via the air discharge valve 25 when filling water into the compartment 11 of the water tank 1. The first chamber 24 is in communication with the first channel 22.

A check valve 5 is sealingly mounted to a lower, open end of the partitioning wall 26. The check valve 5 includes a valve body 52, a flow guide 51 mounted below the valve body 52, a valve plug 54 slideably received in the valve body 52, and an elastic element 55 mounted between the valve plug 54 and the valve body 52. The valve body 52 includes a bottom wall having a longitudinal through-hole 524, a peripheral wall 521 extending longitudinally from a circumference of the bottom wall, and a sleeve portion 522 extending longitudinally from a side of the bottom wall and located within the peripheral wall 521. The flow guide 51 is coupled to a lower end of the peripheral wall 521. The sleeve portion 52 includes a slot 525 in a periphery thereof. Furthermore, at least two longitudinal tracks 523 are formed in an inner face of the periphery of the sleeve portion 522. The valve plug 54 is slideably received in the sleeve portion 522 of the valve body 52. The valve plug 54 includes at least two wings 541 slideably received in the tracks 523 of the sleeve portion 522. The peripheral wall 521 of the valve body 52 is sealingly coupled to the partitioning wall 26 of the cover 2 to thereby seal the first chamber 24. An end of the elastic element 55 abuts against an upper side of the valve plug 54, and the other end of the elastic element 55 abuts against the inner side of the cover 50. The elastic element 55 biases a sealing plate 53 fixed on the valve plug 54 to normally press against and block the through-hole 524 of the valve body 52.

Figure 6:
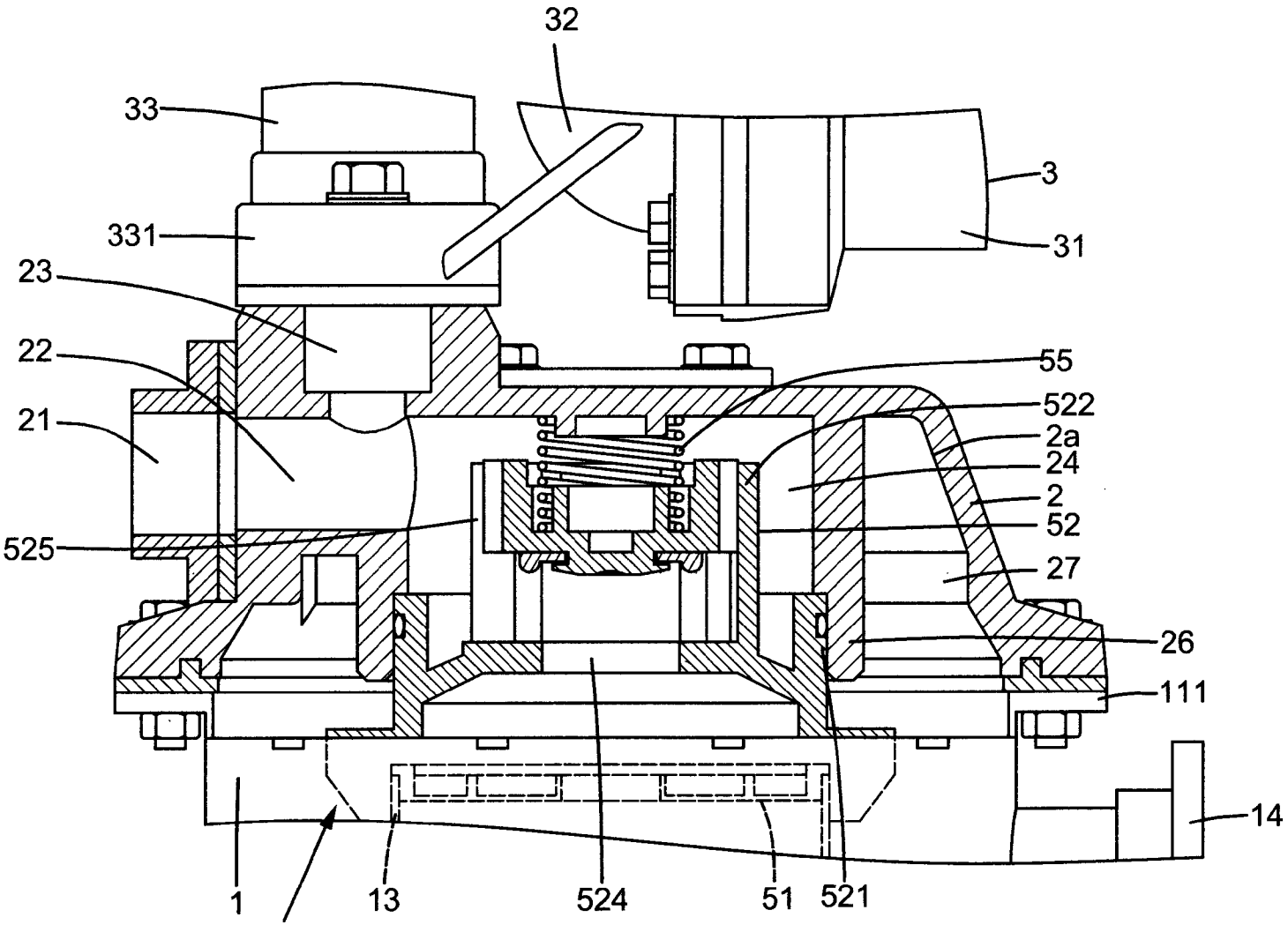
FIG. 6 is a view similar to FIG. 4, illustrating operation of the check valve.

With reference to FIG. 6, the tap water pressurized by the pump 12 is guided by the sleeve 13 and the flow guide 51 into the check valve 5 to push the valve plug 54 away from the through-hole 524. Thus, pressurized tap water flows through the slot 525 into the first chamber 24 and then guided to the user end through the first channel 22. When the pump 12 is off, the valve plug 54 is returned to its original position (see FIG. 4) blocking the through-hole 524 under the action of the elastic element 55. Thus, tap water that has been guided out of the pressurizing water pump is prevented from flowing back into the compartment 11 of the water tank 1.

Figure 2:
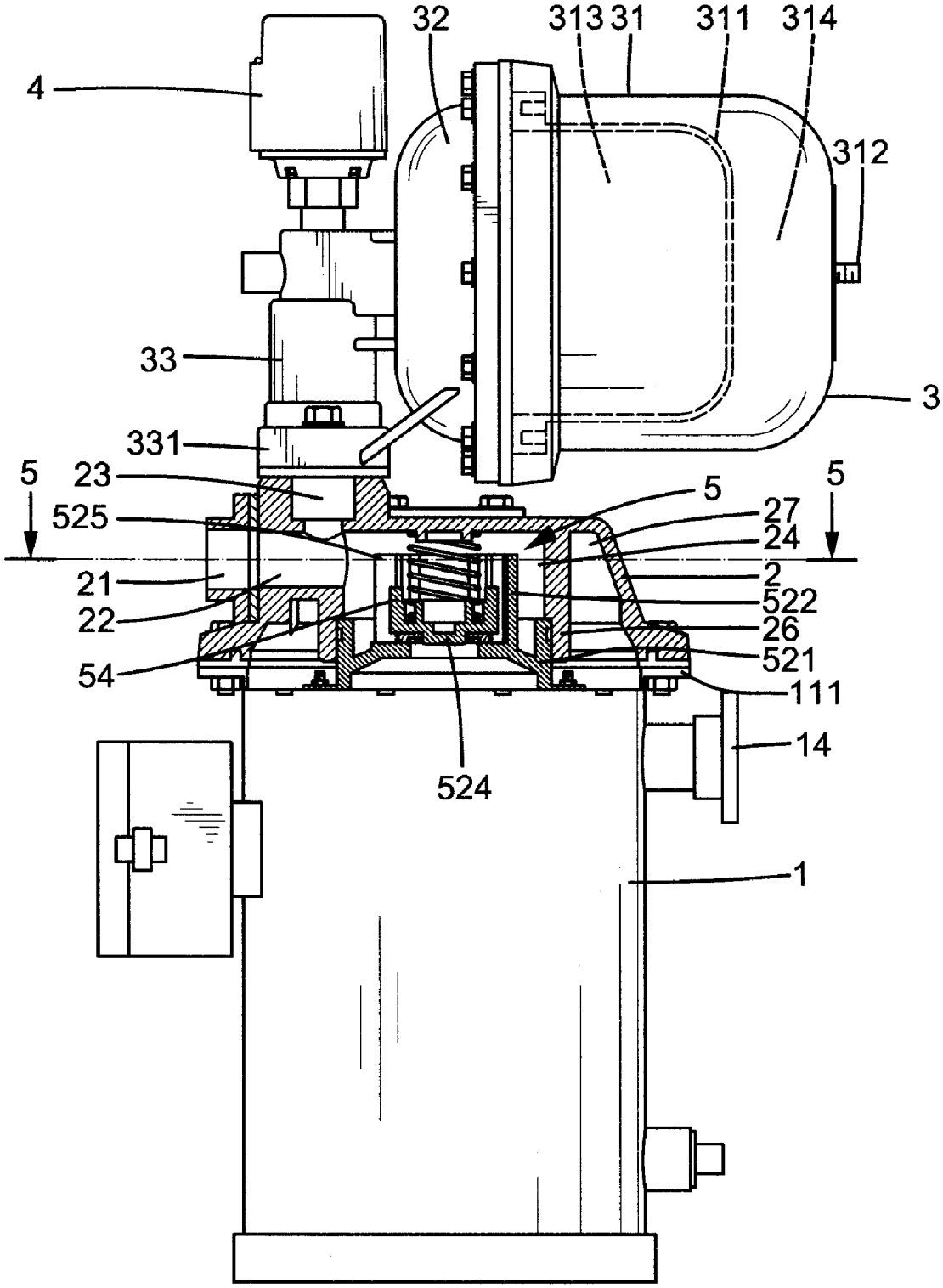
FIG. 2 shows a partially sectioned side view of the constant pressure pressurizing water pump of FIG. 1.
Figure 7:
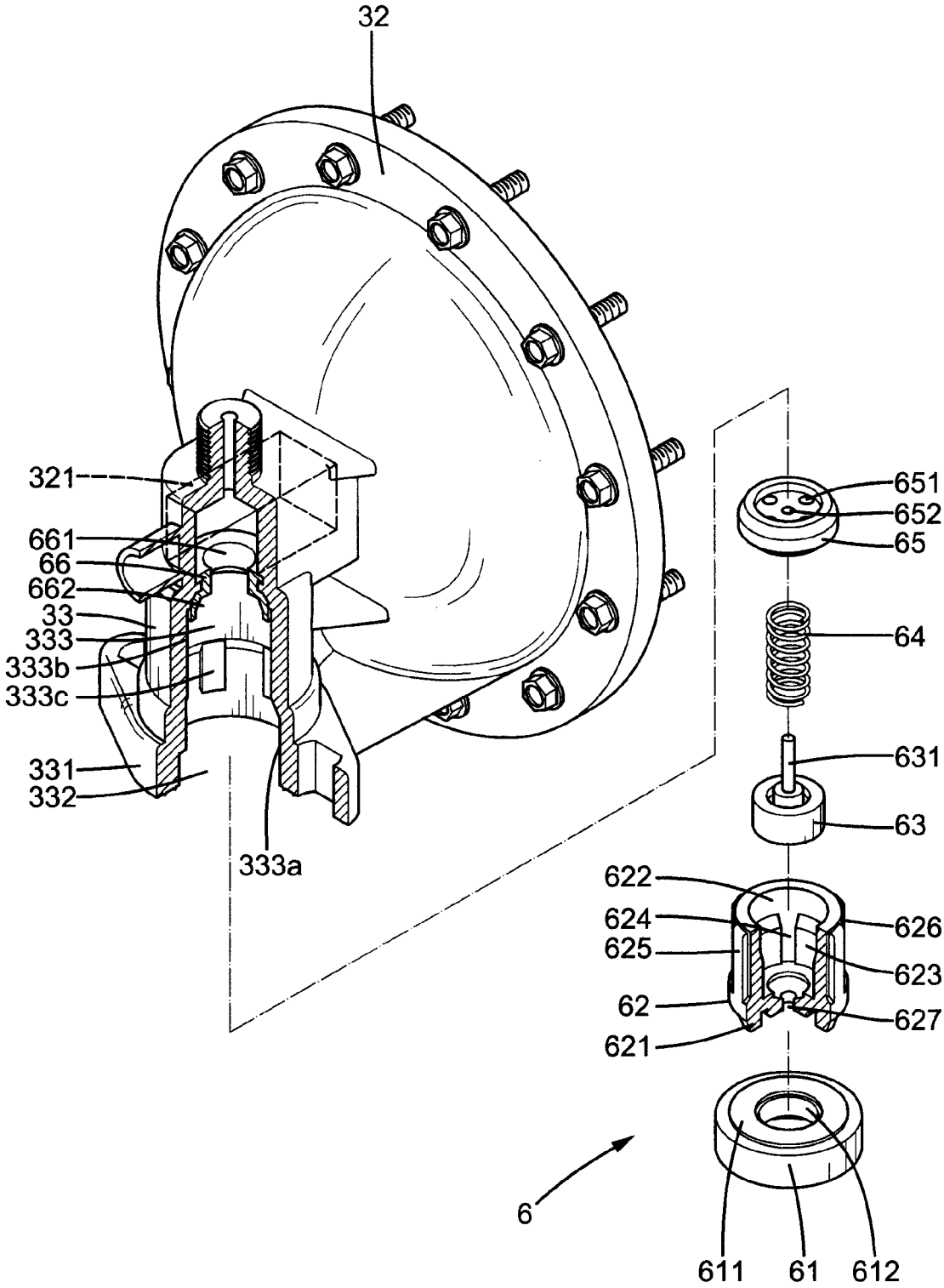
FIG. 7 shows a partial, exploded perspective view of the pressure tank and a differential pressure valve unit of the constant pressure pressurizing water pump of FIG. 1.
Figure 8:
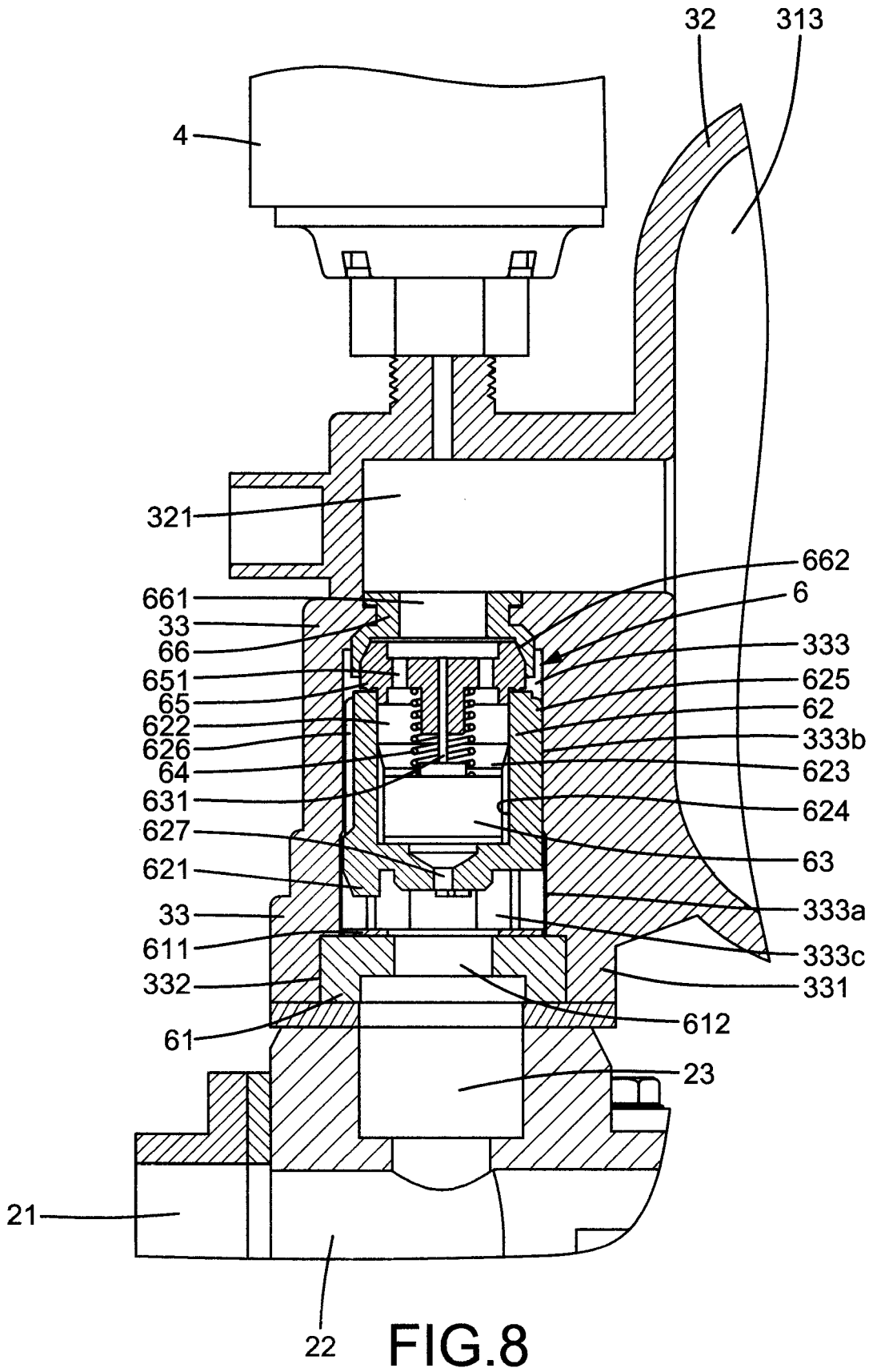
FIG. 8 shows a partial, cross sectional view of the differential pressure valve unit and corresponding components of the constant pressure pressurizing water pump of FIG. 1.

With reference to FIGS. 2, 7, and 8, the pressure tank 3 is mounted on top of the cover 2 and at the outlet of the second channel 23. The pressure tank 3 includes a base 32 and a casing 31 mounted to a side of the base 32. The base 32 includes an extension 33 having a coupling end 331 sealingly coupled with the second channel 23 of the cover 2. A differential pressure valve unit 6 is slideably received in the extension 33. Pressurized tap water can enter the pressure tank 3 via the second channel 23 under control.

A flexible membrane 311 (FIG. 2) is mounted in the casing 31 to separate a compartment defined by the casing 31 and the base 32 into a water chamber 313 in communication with the extension 33 and an air chamber 314. A nozzle 312 is mounted to the casing 31 and in communication with the air chamber 313 for filling air into the air chamber 313 such that the flexible membrane 311 is normally pushed toward the base 32. When pressurized tap water enters the pressure tank 3, the flexible membrane 311 is pushed away from the base 32 under the water pressure, and the pressurized tap water is received in the water chamber 313. If the water pressure in the piping at the user end is smaller than that in the pressure tank 3 and the pump 12 is off, the flexible membrane 311 forces tap water in the pressure tank 3 to flow through the second channel 23 and the first channel 22 to the piping at the user end.

The extension 33 includes a first passageway 321 having an end in communication with the water chamber 313. The extension 33 further includes a second passageway 333 having a front section 333*a* and a rear section 333*b* that is in communication with the other end of the water chamber 313 and that has a diameter slightly smaller than that of the front section 333*a*. A sealing plug 66 is mounted in a rear end opening of the rear section 333*b*. The sealing plug 66 includes a through-hole 661 intermediate the other end of the first passageway 321 and the rear section 333*b*. The through-hole 661 of the sealing plug 66 has an enlarged front portion 662 facing the front section 333*a*. Thus, tap water entering the extension 33 can flow through the second passageway 333 and the first passageway 321 into the water chamber 313 of the pressure tank 3. The front section 333*a* of the second passageway 333 includes a plurality of annularly spaced rubs 333*c* on an inner periphery thereof. Furthermore, the front section 333*a* of the second passageway 333 includes an enlarged portion 332 in a front open end thereof.

The differential pressure valve unit 6 includes a substantially cylindrical valve body 62 slideably received in the second passageway 333. The valve body 62 includes a compartment 622. The valve body 62 further includes an open end, and a closed end defining two ends of the compartment 622. A through-hole 627 is defined in the closed end and in communication with the compartment 622. A plurality of inner ribs 623 are formed on an inner periphery of the valve body 62 defining the compartment 622, and an inner channel 624 is defined between two adjacent inner ribs 623. A plurality of outer ribs 625 are formed on an outer periphery of the valve body 62, and an outer channel 626 is defined between two adjacent outer ribs 625. The outer ribs 625 have a shape conforming to that of the ribs 333*c* in the front section 333*a* of the second passageway 333 to assist in smooth, reliable sliding movement of the differential pressure valve unit 6 in the second passageway 333. The valve body 62 further includes at least one protrusion 621 projecting outward from the outer face of the closed end thereof. When the valve body 62 is in the front section 333*a* of the second passageway 333, tap water can flow through a gap between each pair of ribs 333*c* into the outer channels 626.

An end cap 65 is mounted to and seals the open end of the valve body 62. The end cap 65 includes a central hole 652 and a plurality of through-holes 651 surrounding the central hole 652. A valve plug 63 is slideably received in the compartment 622 has a rod 631 extending from a side thereof through the central hole 652 of the end cap 65. The rod 631 slideably extending through the central hole 652 of the end cap 65 assists in smooth, reliable sliding movement of the valve body 63. The valve plug 63 has a cross-sectional size fittingly and slideably received in a cylindrical space defined by the inner ribs 623 so that water can flow around the valve plug 63 through the inner channels 624.

An elastic element 64 is mounted around the rod 631 and between the end cap 65 and the valve plug 63 to exert a first pressure to the valve body 63 against an inner face of the closed end of the valve body 62 to thereby seal the through-hole 627 of the valve body 62. In this embodiment, the first pressure is 2.5 kg/cm$^2$.

A closure cap 61 is mounted in the enlarged portion 332 of the second passageway 333 to seal the differential pressure valve unit 6 in the second passageway 333. The second passageway 33 has a longitudinal length sufficient to allow sliding movement of the differential pressure valve unit 6 in the longitudinal direction. The closure cap 61 has a through-hole 612 in communication with the second passageway 333 and the second channel 23 to allow pressurized tap water to flow into the pressure tank 3. The differential pressure valve unit 6 only allows tap water having a pressure value greater than the first pressure to enter the pressure tank 3. A washer 611 is mounted to an inner face of the closure cap 61 facing the through-hole 612.

Now that the basic construction of the constant pressure pressurizing water pump of the preferred teachings of the present invention has been explained, the operation and some of the advantages of the constant pressure pressurizing water pump can be set forth and appreciated. FIG. 8 shows a state of the differential pressure valve unit 6 that is moved by water pressure to a position blocking the through-hole 661, wherein the valve body 63 is pushed away from and unseals the through-hole 627. Specifically, when the pump 12 operates, pressurized tap water pushes the differential pressure valve unit 6 until the end cap 65 enters and seals the enlarged portion 662 of the through-hole 661 of the sealing plug 66. If the pressure of water entering the second channel 23 is lower than 2.5 kg/cm$^2$, the water pressure is insufficient to overcome the biasing force of the elastic element 64 and, thus, cannot push the valve body 63. As a result, the through-hole 627 is sealed whereas the end cap 65 seals the through-hole 661 of the sealing plug 66. As a result, pressurized tap water cannot enter the pressure tank 3 via the through-hole 661. On the other hand, if the pressure of water entering the second channel 23 is larger than 2.5 kg/cm$^2$, the water pressure overcomes the biasing force of the elastic element 64 and pushes the valve body 63 away from the through-hole 627. Thus, the through-hole 627 is open, and tap water can flow around the valve plug 63 through the inner channels 624 and exits the differential pressure valve unit 6 through the through-hole 651 of the end cap 65. Then tap water enters the pressure tank 3 via the through-hole 661 of the sealing plug 66 and the first passageway 321.

The output water pressure of the pump 12 is 3 kg/cm$^2$. If water is continuously output at the user end, the water pressure output by the pump 12 cannot be maintained at a value sufficient to overcome the biasing force of the elastic element 64 (namely the water pressure becomes smaller than 2.5 kg/cm$^2$). In this case, the valve body 63 cannot be pushed away, and tap water cannot enter the pressure tank 3. If water output at the user end stops, the pump 12 keeps pumping tap water to increase the water pressure until it becomes higher than 2.5 kg/cm$^2$. The water pressure is now sufficient to push the valve body 63 to allow pressurized tap water to enter the pressure tank 3. The water pressure inside the pressure tank 3 is increased accordingly.

Figure 9:
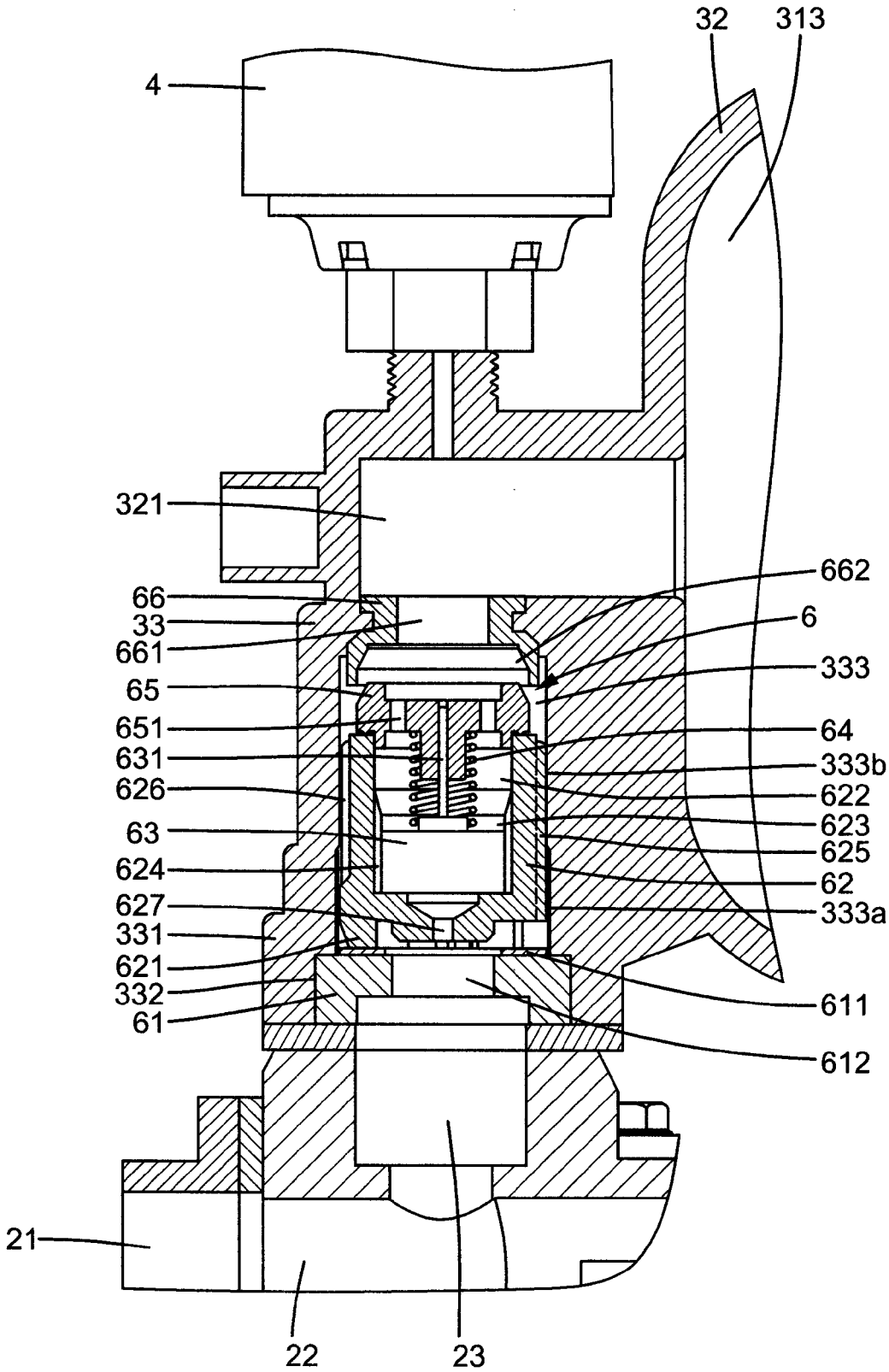
FIG. 9 is a view similar to FIG. 8, illustrating operation of the pressure-difference type valve unit.

With reference to FIG. 9, when water is output at the user end without activating the pump 12, the water pressure in the piping at the user end and inside the pressurizing water pump drops. The differential pressure valve unit 6 is pushed by the water pressure in the pressure tank 3 toward the closure cap 61 until the protrusion 621 abuts against the washer 611 of the closure cap 61. A gap existing between the end face of valve body 62 and the closure cap 61 allows passage of tap water. The end cap 65 is disengaged from the enlarged front portion 662 of the through-hole 661 of the sealing plug 62. The through-hole 661 of the sealing plug 62 is not blocked, and tap water in the pressure tank 3 is squeezed outward by the flexible membrane 311 to flow through the outer channels 626 of the valve body 62 and the water passageways between each pair of ribs 333*c* and then output through the through-hole 612 of the closure cap 61 to the piping at the user end. The water pressure in the pressure tanks 3 is lowered.

The power switch 4 is mounted on the extension 33 of the base 32 of the pressure tank 3 and in communication with the first passageway 321. The power switch 4 operates at a preset second pressure value lower than the first pressure value and at a preset third pressure value lower than the second pressure value. In this embodiment, the second pressure value is 2.4 kg/cm$^2$, and the third pressure value is 1.2 kg/cm$^2$. Other operating pressure values of the power switch 4 would be within the skill of the art. The second and third pressure values are set according to the magnitude of the biasing force of the elastic element 64 and the output pressure of the pump 12.

The water pressure in the pressure tank 3 is increased by the tap water that enters the pressure tank 3. If the pressure switch 4 detects the water pressure in the pressure tank 3 reaches the second pressure value, the pressure switch 4 turns the pump 12 off. If water pressure in the pressure tank 3 drops due to output of water in the pressure tank 3, the pump 12 is activated again when the water pressure detected by the pressure switch 4 is lower than the third pressure value. In a case that water is continuously output at the user end, the pressure in the pressuring water pump is insufficient to overcome the biasing force of the elastic element 64 such that pressurized tap water cannot enter the pressure tank 3. Thus, the pressure value in the pressure tank 3 is kept below the third pressure value, and the pump 12 keeps running to provide stable supply of water with constant water pressure to the user end. Unstable water output is, thus, avoided.

The constant pressure pressuring water pump according to the preferred teachings of the present invention provides a compact structure by the integral design of the cover 2 and the check valve 5 plus provision of the first and second chambers 24 and 27 and the first and second channels 22 and 23 in the cover. The compact constant pressure pressurizing water pump according to the preferred teachings of the present invention attains functions achieved by conventional bulky, complicated pressurizing water pumps while avoiding disadvantages of the conventional pressurizing water pumps. The simple structure of the compact constant pressure pressurizing water pump according to the preferred teachings of the present invention allows easy assembly and cuts the manufacturing costs.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A water pressurizing pump comprising:

a water tank (1) including a compartment (11) for receiving water;

a pump (12) mounted in the compartment (11) for pressurizing and outputting water in the compartment (11) of the water tank (1);

a cover (2) mounted on top of the water tank (1) to seal the compartment (11) of the water tank (1), with the cover (2) including a space (2*a*) in communication with the compartment (11) of the water tank (1), with the cover (2) further including a first channel (22) having a first end in communication with the space (2*a*) of the cover (2) and a second end adapted to be coupled with a water supply coupler (21), with the cover (2) further including a second channel (23) having a first end in communication with the first channel (22) and a second end, and with pressurized water being outputable through the first channel (22) to the water supply coupler (21);

a pressure tank (3) mounted to and in communication with the second end of the second channel (23) of the cover (2), a differential pressure valve unit (6) slidably mounted in the second channel, the differential pressure valve unit (6) being movable by a pressure of pressurized water in the second channel (23) higher than a first pressure value to allow water from the second channel (23) to enter the pressure tank (3);

a pressure switch (4) mounted on and in communication with the pressure tank (3) for detecting water pressure in the pressure tank (3), with the pump (12) being turned off when the water pressure in the pressure tank (3) is higher than a second pressure value that is lower than the first pressure value, and with the pump (12) being activated when the water pressure in the pressure tank (3) is lower than a third pressure value that is lower than the second pressure value;

wherein the cover (2) further includes a partitioning wall (26) that separates the space (2*a*) into a first chamber (24) and a second chamber (27), with the first chamber (24) being in communication with the first channel (22) and the second chamber (27) being in communication with the compartment (11) of the water tank (1); further comprising, in combination: a check valve (5) mounted in the first chamber (24) and coupled with a water output end of the pump (12), the check valve (5) allowing pressurized water from the pump (12) to enter the first channel (22) and preventing flow of pressurized water in a reverse direction; and an air discharge valve (25) mounted in the second chamber (27) for discharging air in the compartment (11) of the water tank (1) when filling water into the compartment (11) of the water tank (1).

2. The water pressurizing pump as claimed in claim 1, with the pressure tank (3) including a base (32) and a casing (31) mounted to the base (32) to together define a compartment, the base (32) including an extension (33) including a passageway (333) in communication with the compartment of the pressure tank (3), with the passageway (333) including a front section (333*a*) and a rear section (333*b*) having an inner diameter slightly smaller than that of the front section (333*a*), with the differential pressure valve unit (6) being slideably received in the front section (333*a*) and having an outer diameter conforming to the inner diameter of the front section (333*a*), further comprising, in combination: a sealing plug (61) mounted in an end of the front section (333*a*) adjacent to the second channel (23), with the sealing plug (61) preventing the differential pressure valve unit (6) from moving out of the passageway (333), and with the sealing plug (61) having a through-hole (611) in communication with the second channel (23) and the passageway (333).

3. The water pressurizing pump as claimed in claim 2, with the compartment of the pressure tank (3) including a water chamber (313), with the rear section (333*b*) of the passageway (333) of the extension (33) of the base (32) having an end in communication with the water chamber (313), further comprising, in combination: a sealing plug (66) mounted in the end of the rear section (333*b*) of the passageway (333) and having a through-hole (661) in communication with the water chamber (313) and the rear section (333*b*), with the through-hole (661) of the sealing plug (66) having an enlarged front portion (662) facing the front section (333*a*), with the differential pressure valve unit (6) including an end cap (65), with the end cap (65) being sealingly engaged in the enlarged front portion (662) of the through-hole (661) of the sealing plug (66) when the differential pressure valve unit (6) is pushed by the water pressure from the second channel (23), preventing water from entering the pressure tank (3) through the differential pressure valve unit (6).

4. The water pressurizing pump as claimed in claim 3, with the differential pressure valve unit (6) further including, in combination: a valve body (62) slideably received in the passageway (333) of the extension (33) of the base (32), with the valve body (62) including a compartment (622) having an open end, with the valve body (62) further including a plurality of outer ribs (625) on an outer periphery thereof, with an outer channel (626) being defined between two adjacent outer ribs (625) and; a valve plug (63) slideably received in the compartment (622) of the valve body (62), with the end cap (65) being mounted in the open end of the compartment (622) of the valve body (62), with the end cap (65) including at least one through-hole (651) in communication with the compartment (622) of the valve body (62), with water the second channel (23) being flowable through the compartment (622) of the valve body (62) and at least one through-hole (651) of the end cap (65) to the water chamber (313) of the pressure tank (3) when the water pressure in the water chamber (313) is higher than the first pressure value, with water in the water chamber (313) of the pressure tank (3) being flowable through the outer channel (626) to the second channel (23) when the water pressure in the water chamber (313) is higher than the water pressure in the second channel (23).

5. The water pressurizing pump as claimed in claim 4, with the valve body (62) of the differential pressure valve unit (6) further including at least one protrusion (621) on an end thereof facing the closure cap (61), with said at least one protrusion (621) pressing against the closure cap (61) when the differential pressure valve unit (6) is pushed by the water pressure in the pressure tank (3) toward the closure cap (61), allowing water in the water chamber (313) to flow through the outer channels (626) and the through-hole (612) of the closure cap (61) to the second channel (23).

6. The water pressurizing pump as claimed in claim 4, with the valve body (62) of the differential pressure valve unit (6) further including a plurality of ribs (623) on an inner periphery thereof, with an inner channel (624) being defined between two adjacent inner ribs (623), with the valve body (62) of the differential pressure valve unit (6) further including a through-hole (627) in another end opposite to the open end of the compartment (622) thereof, with the differential pressure valve unit (6) further comprising, in combination: an elastic element (64) mounted in the valve body (62) and between the valve plug (63) and the end cap (65) to bias the valve plug (63) to press against the other end of the valve body (62) for sealing the through-hole (627) of the valve body (62), with the valve plug (63) being pushed away from and unsealing the through-hole (627) of the valve body (62) when the water pressure in the second channel (23) is larger than a biasing force of the elastic element (64), allowing water in the second channel (23) to flow through the through-hole (627) and the inner channels (624) of the valve body (62) and the through-hole (651) of the end cap (65) into the water chamber (313) of the pressure tank (3).

* * * * *